US005603475A

United States Patent [19]

Lim

[11] Patent Number: 5,603,475

[45] Date of Patent: Feb. 18, 1997

[54] RACK STRUCTURE

[76] Inventor: Yang-mook Lim, 805, Jinheung Apt. 3-dong, Dunchon 2-dong, Kangdong-ku, Seoul, Rep. of Korea

[21] Appl. No.: 176,711

[22] Filed: Jan. 3, 1994

[30] Foreign Application Priority Data

Jan. 11, 1993 [KR] Rep. of Korea ..... 93-276

[51] Int. Cl.[6] ..... A47B 96/06

[52] U.S. Cl. ..... 248/222.14; 411/82

[58] Field of Search ..... 248/220.2, 222.1, 248/222.2, 221.3, 220.22, 221.11, 222.13, 222.14; 411/82, 400, 401, 388; D8/352

[56] References Cited

U.S. PATENT DOCUMENTS

| | | | |
|---|---|---|---|
| 1,940,888 | 12/1933 | Smith | 248/222.1 |
| 2,258,264 | 10/1941 | Schultz | 248/221.3 |
| 2,506,602 | 5/1950 | Laystrom et al. | 248/222.1 X |
| 3,188,038 | 6/1965 | Grout | 248/222.1 |
| 3,463,525 | 8/1969 | Stewart | 411/82 X |
| 3,552,734 | 1/1971 | Severino | 411/400 X |
| 4,566,662 | 1/1986 | Toshishige | 248/222.1 |

*Primary Examiner*—Korie Chan

*Attorney, Agent, or Firm*—Gerald E. Hespos; Anthony J. Casella

[57] ABSTRACT

This invention is related to a convenient and multi-purpose rack structure, especially it is related to a rack structure whose materials can be plastic metal or porcelain, all materials typically used in towel racks, tooth brush holders, sinks, electric appliances, chandeliers and decorations. This invention discloses a rack structure comprising a fixing part (3) which has both ends bent and screw holes (41), screws (4) inserted through an installing part (2) which has an opening (2A) to receive the fixing part (3), a strengthen holder (5), and a hole to insert a bolt (4) to sustain the installing part (2) on the wall. The strengthen holder (5) forms steps to adapt the holder on the bottom of the opening (2A) of the installing part (2).

2 Claims, 14 Drawing Sheets

RACK STRUCTURE

BACKGROUND OF THE INVENTION

This invention is related to a convenient and multi-purpose rack structure, especially it is related to a rack structure whose materials can be plastic, metal, porcelain, ceramic, or jade, all materials typically used in towel racks, tooth brush holders, sinks, electric appliances, and decorations.

In the prior art, to install a rack or holder (like a towel rack etc.) on a wall of concrete or tiles, the rack was adjusted to the corresponding place on the wall and then mounted with tools like concrete nails, nuts and bolts or adhesive agent. The mounting places could have been prepared with holes by means of a drill, and nuts or bolts were inserted into the holes to mount the rack.

However such mounting method cannot improve the efficiency of the works and cannot allow the movement of such installation once fixed. If the installation would be removed, the scars on the wall left by the former installation cannot be cured and remain as damage to the wall's beauty. Also the holes left behind were not available for use again.

This invention is provided to solve these defects and to install the racks or the holders simply and beautifully onto a wall.

BRIEF SUMMARY OF THE INVENTION

It is an object of the invention to provide a rack structure to be installed simply, beautifully and strongly without damaging the appearance of the wall.

It is another object of this invention to provide various hanging structures for use with any kind of hanging materials on the wall simply and firmly.

An additional object of this invention is to provide rack structures to install various hanging structures made with various materials, such as porcelain, plastic, ceramic, and jade.

The objects and advantages of the invention will become apparent during the following description of the accompanying drawings.

Figure 1A:
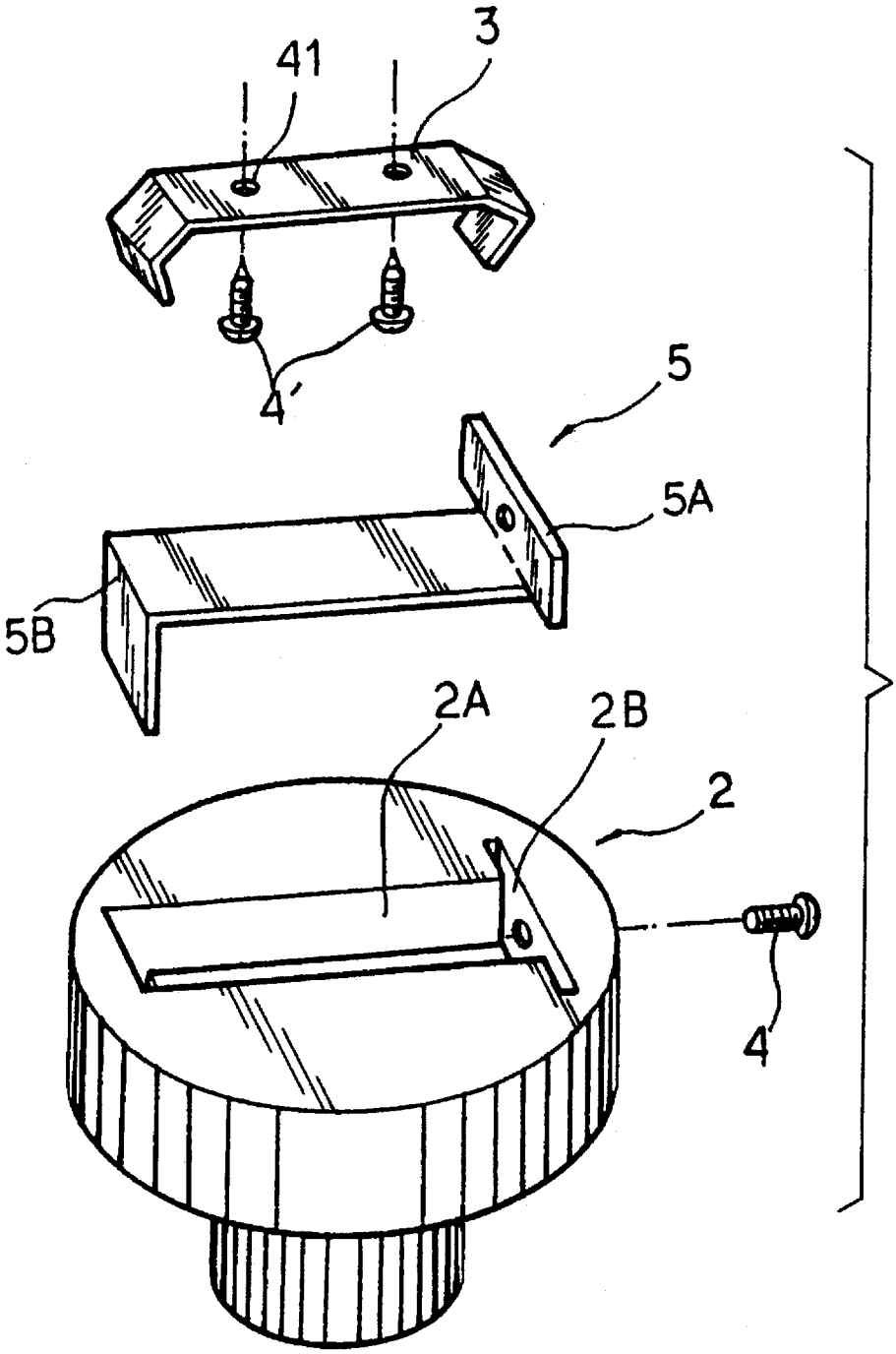
FIG. 1(A) is an exploded perspective view of an embodiment of the rack structure according to this invention.

Description of Symbols of the Main Parts in the Drawings

| | |
|---|---|
| 1 . . . rack cane | 2 . . . installing part |
| 2A . . . opening | 2B . . . inserting groove |
| 2C . . . sloped part | 3 . . . fixing part |
| 4 . . . bolt | 4' . . . screw or nail |
| 41 . . . screw hole | 5,50 . . . strengthen holder |
| 6 . . . plastic screw holder | 6A . . . protrusion |
| 6B . . . torn part | 7 . . . upholder |
| 8 . . . combining member | 9,19 . . . nut |
| 10 . . . wall | 40 . . . joint bolt |

DETAILED DESCRIPTION OF THE INVENTION

Figure 1B:
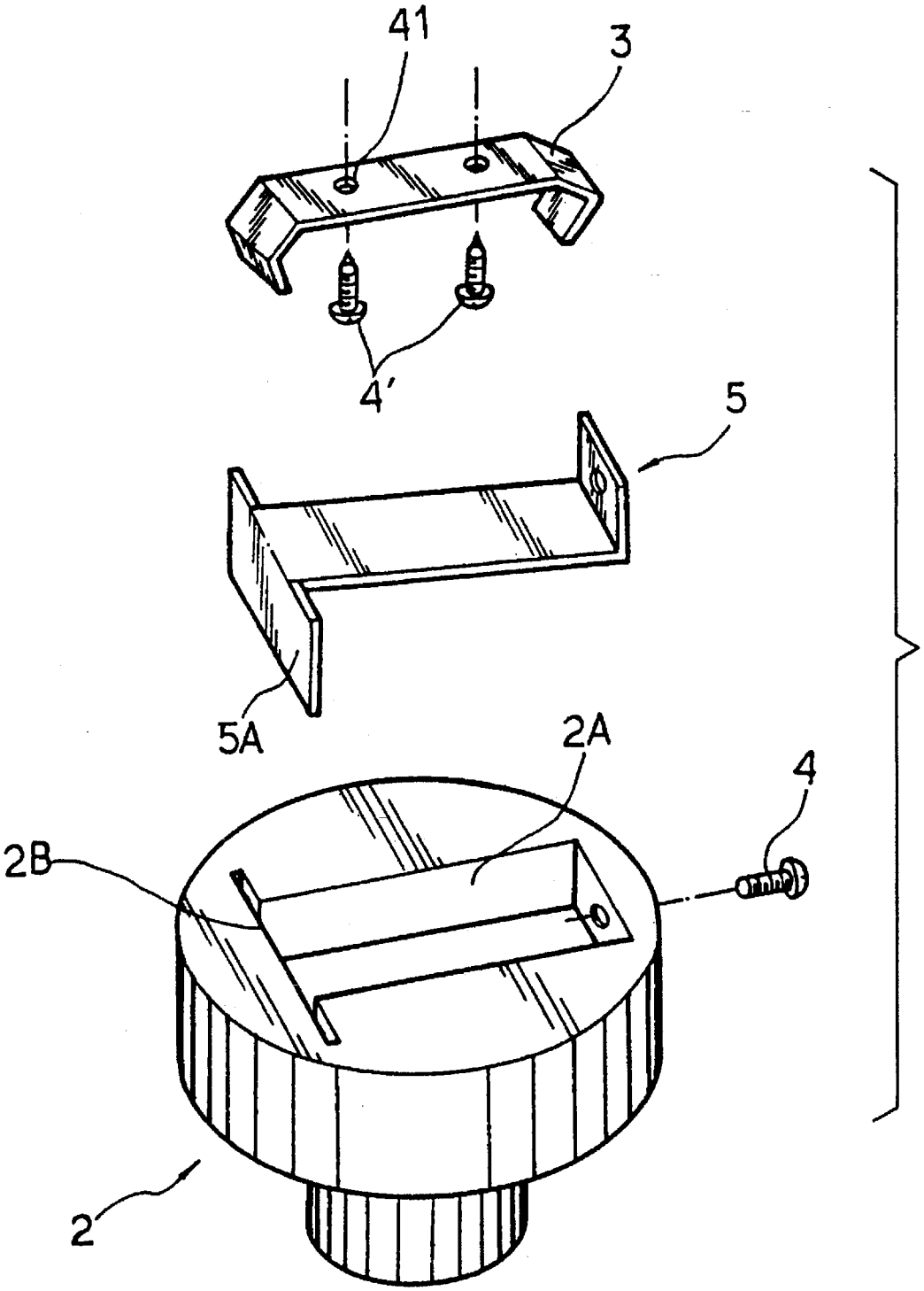
FIG. 1(B) is an exploded perspective view of another embodiment of the rack structure according to this invention.
Figure 1C:
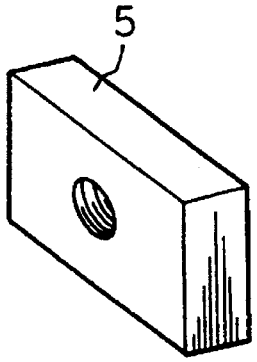
FIGS. 1(C)(D)(E) are other examples of the strengthen holder used in the rack structure according to this invention.
Figure 1D:
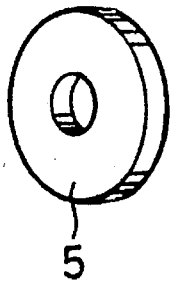
Figure 1E:
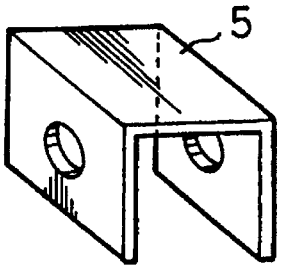
Figure 2:
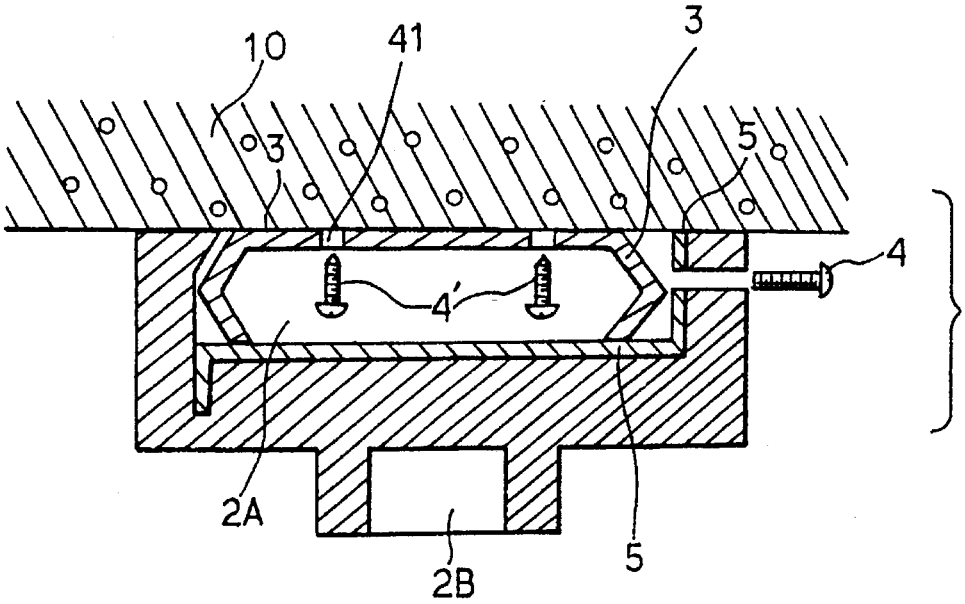
FIG. 2 is a sectional view of the rack structure installed on a wall.
Figure 3:
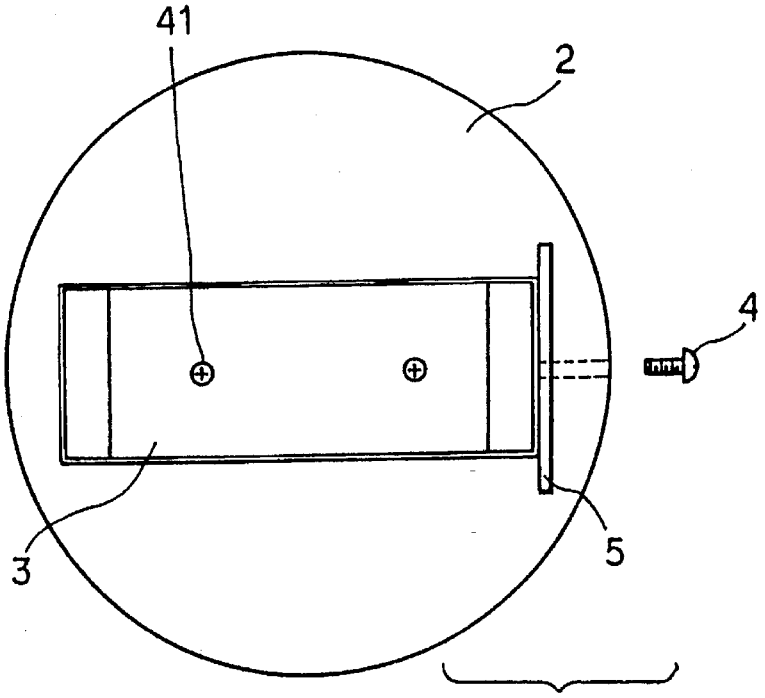
FIG. 3 is a plan view of the rack structure according to the invention.

FIG. 1(A) is an exploded perspective view of an embodiment of the rack structure according to this invention. FIG. 1(B) is also another embodiment of the rack and FIGS. 1(C)(D)(E) are examples of strengthen holder (5), according to this invention. FIGS. 2 and 3 are the sectional view and the plan view of the combined rack structure according to this invention.

The holder structure according to this invention consists of a fixing part (3) having both ends bent and screw holes (41) in its center, a strengthen holder (5) of "⌐" shape inserted into the opening (2A) of installing part (2) and the installing part (2) receiving the strengthen holder (5) and fixed on the fixing part (3) by bolt (4).

The strengthen holder (5) is folded over to form "⌐" shape with a bolt hole on its upper vertical part (5A), and it is inserted into the opening (2A) with adjusting its vertical part (5A) into the groove (2B) to reinforce the holding power enough to sustain the weight of the hanging matters on the wall.

The fixing part (3) is installed on the wall with screws (4') and its one folded end supports the bolt (4) combined with the strengthen holder (5), and the other end of the strengthen holder (5) is hooked into the depressed part of the opening (2A) (not shown in the FIG. 1).

FIG. 1(B) is an exploded perspective view of another embodiment of the rack structure according to this invention. In this embodiment the strengthen holder (5) has the vertical part (5A) at the opposite side to the embodiment of FIG. 1(A), and the holding efficiency is different. As shown in FIGS. 1(C)(D)(E), various types of strengthen holders (5), for example rectangular, circular or two-holed typed holders, are displayed to be adopted on the installing part (2) to reinforce the holding power of the installing part (2).

For the detailed description of the rack structure according to this invention as shown in FIG. 1(A), the operation and effectiveness of this embodiment is as follows:

In FIG. 2 and FIG. 3, a sectional view and a plan view of the rack structure installed on the wall are shown, the fixing part (3) is mounted on the wall by the screws (4'), and the strengthen holder (5) is inserted into the opening (2A) of installing part (2) and assembled partly with the bolt (4). The assembled installing part (2) receives the fixing part (3) into the opening (2A) and is fixed on the wall by the bolt (4) completely. The strengthen holder (5) is used for reinforcing the fixing ability of the rack structure or holder structure to the wall even if the rack structure is made of, for example, porcelain which is comparatively weak in sustaining the weight of hanging matters. The inserting groove (2B) is formed on the opposite side of the opening (2A) to receive the rack cane (1) for holding the towel or the like.

Figure 4:
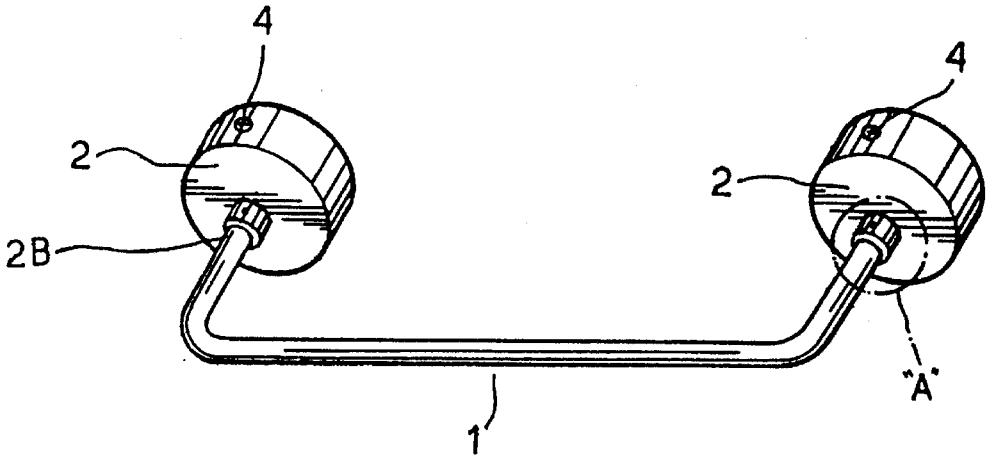
FIG. 4 is a perspective view of the tow rack according to this invention.
Figure 5:
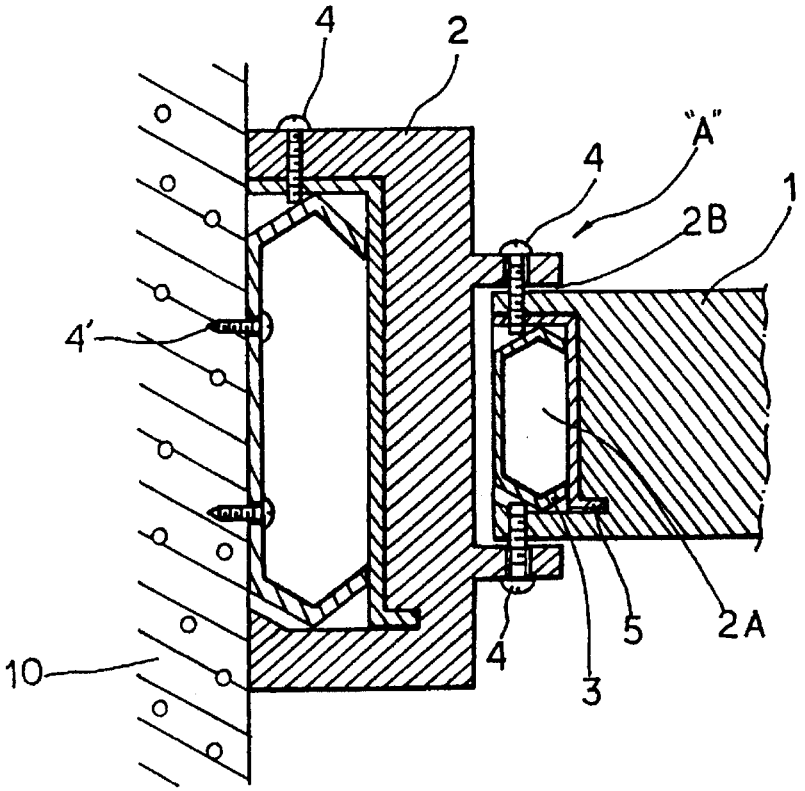
FIG. 5 is a sectional view of part "A" of FIG. 4.

FIG. 4 shows the rack which is installed on the wall according to this embodiment of the invention. In this embodiment, two installing parts (2) are installed on the wall and the rack cane (1) is assembled with the rack structures as shown in FIG. 5. The method of combining the rack cane (1) and the installing parts (2) is very similar to that of the method of installation on the wall, except several screws or nails are used to tighten the assembly of the rack cane (1). The reason why the rack cane (1) is held within the fixing part (3) by means of the strengthen holder (5) is because if the rack or rack cane is made of porcelain the connecting part between the rack and rack cane is apt to be destroyed by any small impact. Especially when various forms of the installing part (2) are adopted, e.g., with porcelain used for decoration or the fixing part (3), the strengthen holder (5) has to be inserted into the installing part (2) to get a certain degree of strength in the connection part (A) to sustain impacts.

Figure 6:
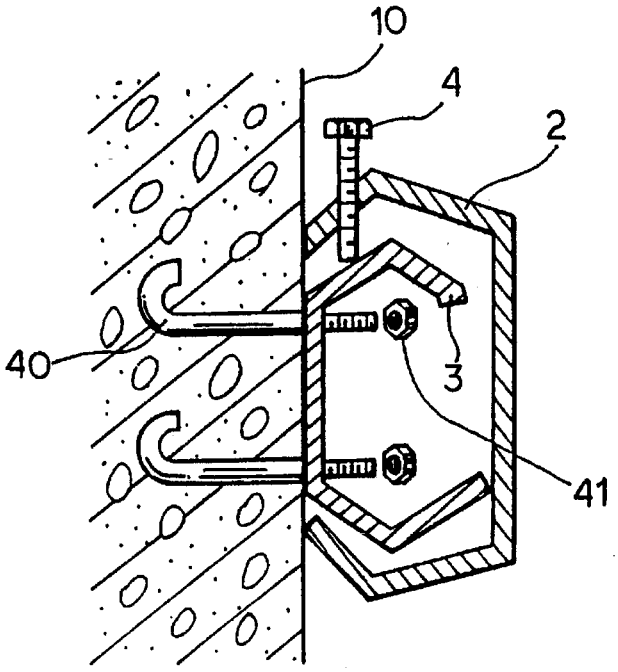
FIG. 6 is a sectional view of another fixing part installed on a wall.

FIG. 6 is a sectional view of another embodiment of the rack structure installed on the wall. Large hangings, for example, a signboard, can be fixed on the wall with this structure installed on the wall. One end of the fixing screws or nails (40) are bent to be sure of being hooked into the wall to sustain heavy weight, and several screws are installed in the wall to mount the fixing part (3) with fixing screws (40) and nuts (41). Then the signboard is installed by placing the installing part (2) on the assembly with the fixing parts on the wall and screwing the bolts (4) from the side. With this structure, a big sign board or illumination facilities, which may have been difficult to install on the wall, are easily established on the wall or on the ceiling.

Figure 7:
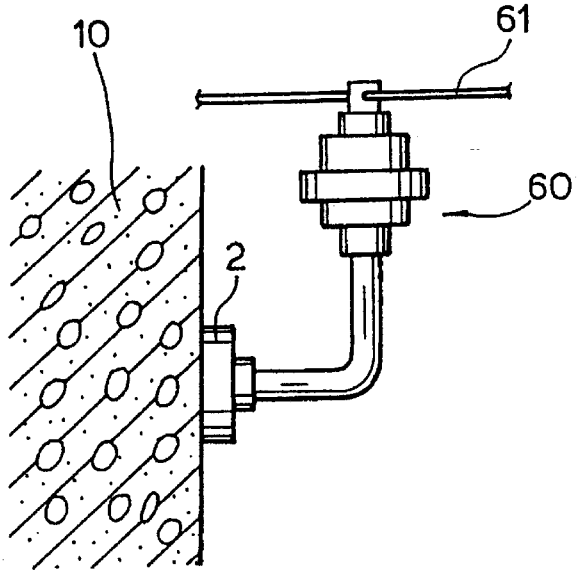
FIG. 7 is a perspective view of line supporter installed on the wall as an embodiment according to this invention.

FIG. 7 is a perspective view of an electric line supporter installed on the wall as an embodiment according to this invention. The rack structure consists of an insulator (60) and a hanging post (61).

Figure 8:
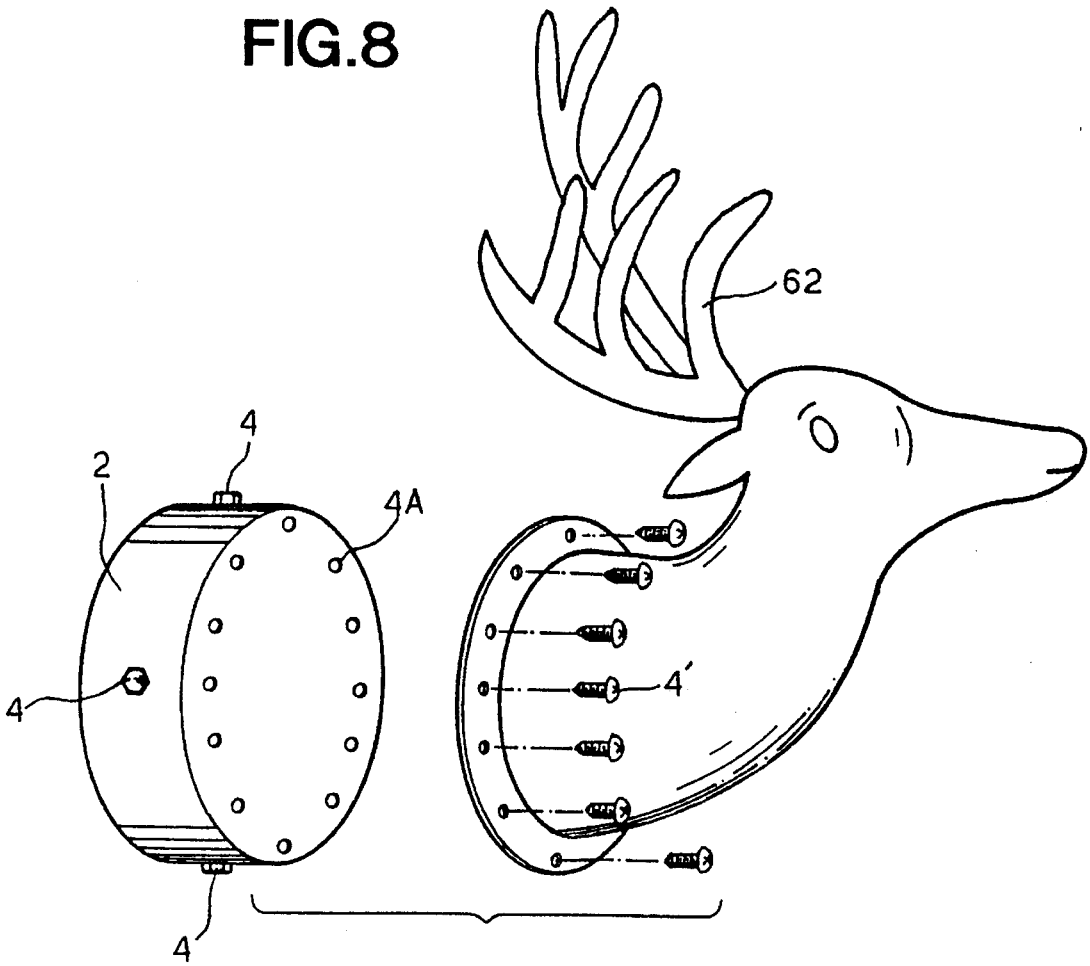
FIG. 8 is a perspective view of a stuffing installed on the wall as another embodiment according to this invention.
Figure 9:
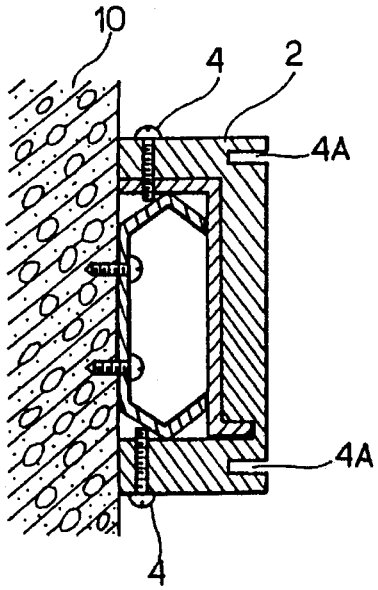
FIG. 9 is a sectional view of the installing part shown in FIG. 8.

FIG. 8 is a perspective view of a stuffing installed on the wall as another embodiment of the holder structure according to this invention. FIG. 9 shows a sectional view of the stuffing installed on the wall with referring to FIG. 8. In this embodiment there are holes (4A) formed around the installing part (2) and the ornamental stuffing is hung on the wall with assembling screws (4') through the screw holes (4A).

Figure 10:
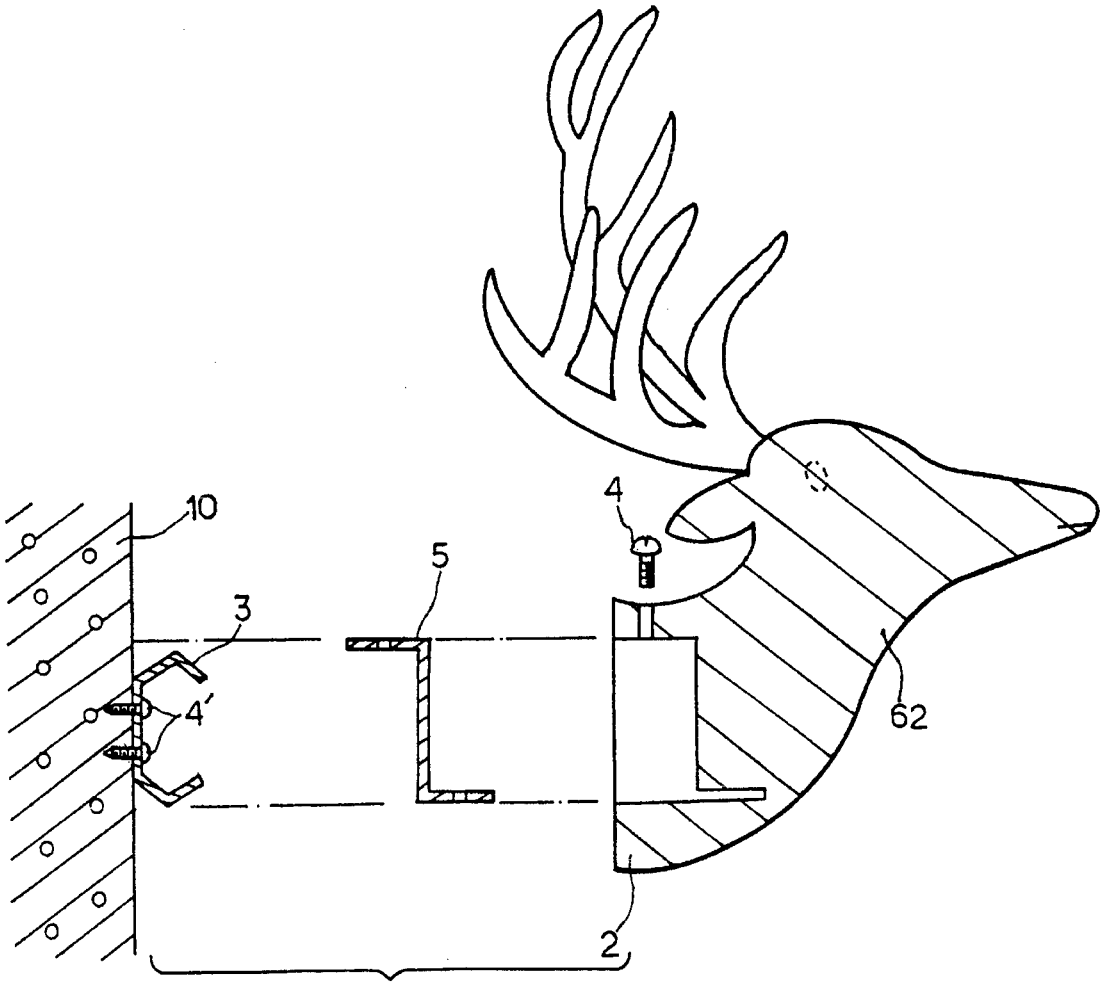
FIG. 10 is a sectional view of another embodiment of a holder according to this invention.
Figure 11:
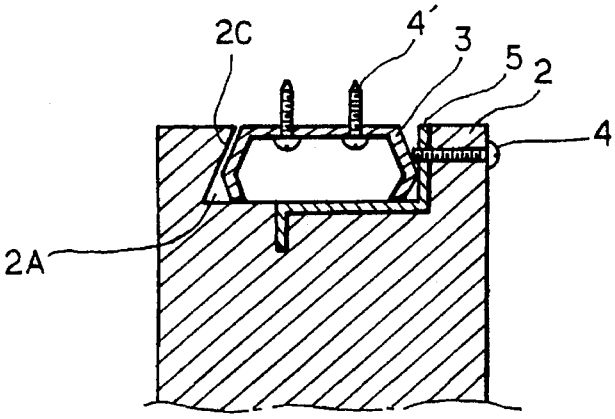
FIG. 11 is a sectional view of another embodiment of the rack structure according to this invention.

FIG. 10 is a sectional view of another embodiment of the holder according to this invention, whose installing part (2) receives the strengthen holder (5) and ornaments (62) which are assembled together with the fixing part (3) by screwing bolts (4) at one side. The other embodiment referred to in FIG. 10 is shown as a sectional view of the assembled rack in FIG. 11. In FIG. 11 a sloped part (2C) is formed on one side of the opening (2A), and the bolt (4) is assembled on the opposite side of the sloped part to increase the strength of the rack structure. Various holders, used in the kitchen or with furniture which typically endure more weight, can be formed or displayed in this embodiment. Therefore the installing part (2) can be formed as a holder or handle in the kitchen or on furniture by assembling fixing part (3) and strengthen holder (5) with screwing bolts (4).

In this embodiment of the invention, the installing part (2) can be formed of porcelain, marble, jade or ceramic with a beautiful sculpture or pattern for ornamental effectiveness; yet the invention is strong enough to sustain the weight of what it is supporting.

Figure 12:
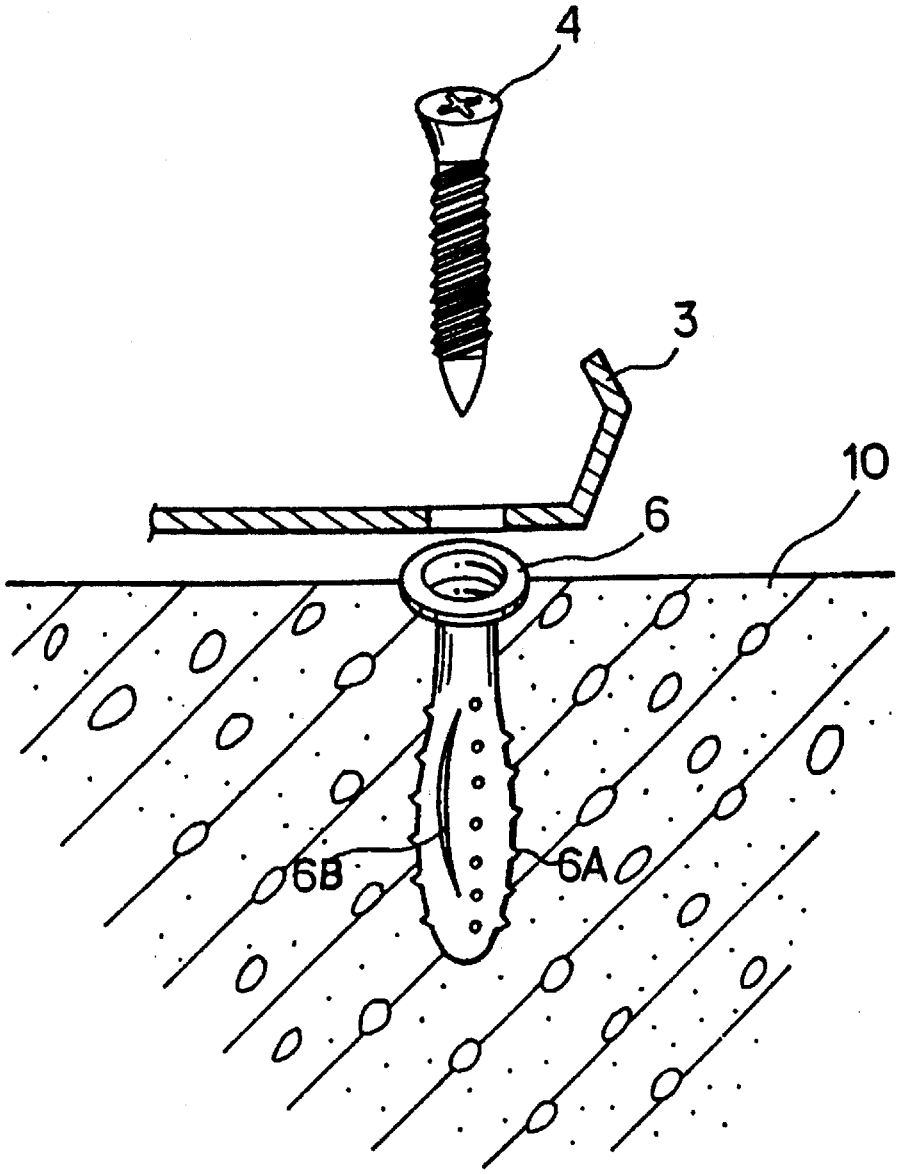
FIG. 12 is a sectional view of the fixing part of the rack structure according to the invention.

FIG. 12 shows a sectional view of a plastic screw holder (6) buried in a cement wall for receiving screws (4') and attaching the fixing part (3) on the wall (10). To drive a nail or a screw into a cement wall is very difficult because of the hardness of cement, and to change the position of a driving nail or screw is also difficult because of the crumbling characteristics of a cement wall. To avoid such problems, the plastic screw holder (6) can be used, which comprises many protrusions (6A) and torn parts (6B) to give flexibility when the screw (4) is inserted.

Figure 13A:
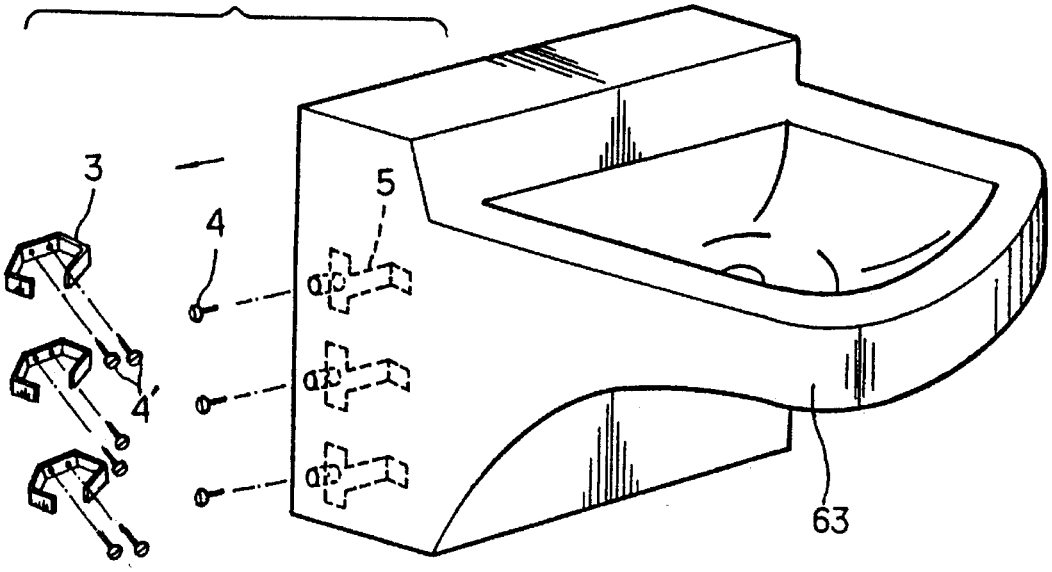
FIGS. 13(A) and (B) are the exploded views of a sink holder installed on the wall according to this invention.
Figure 13B:
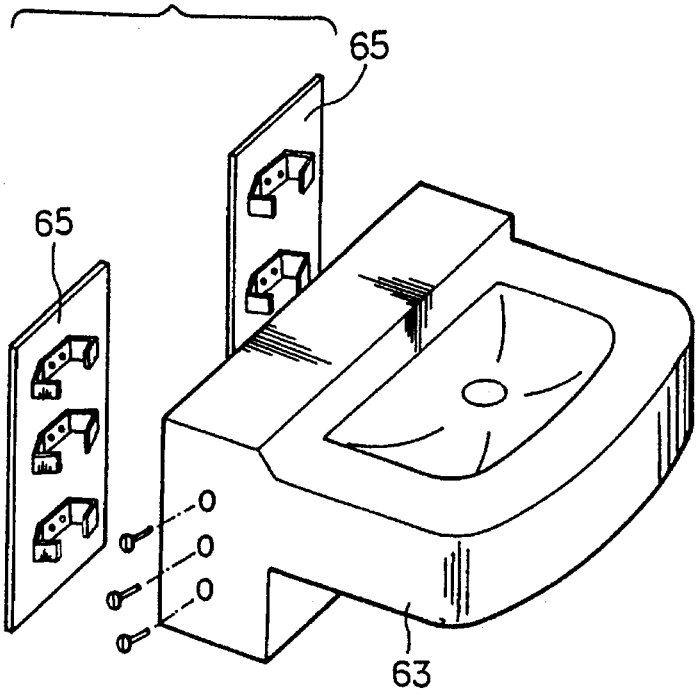
Figure 14:
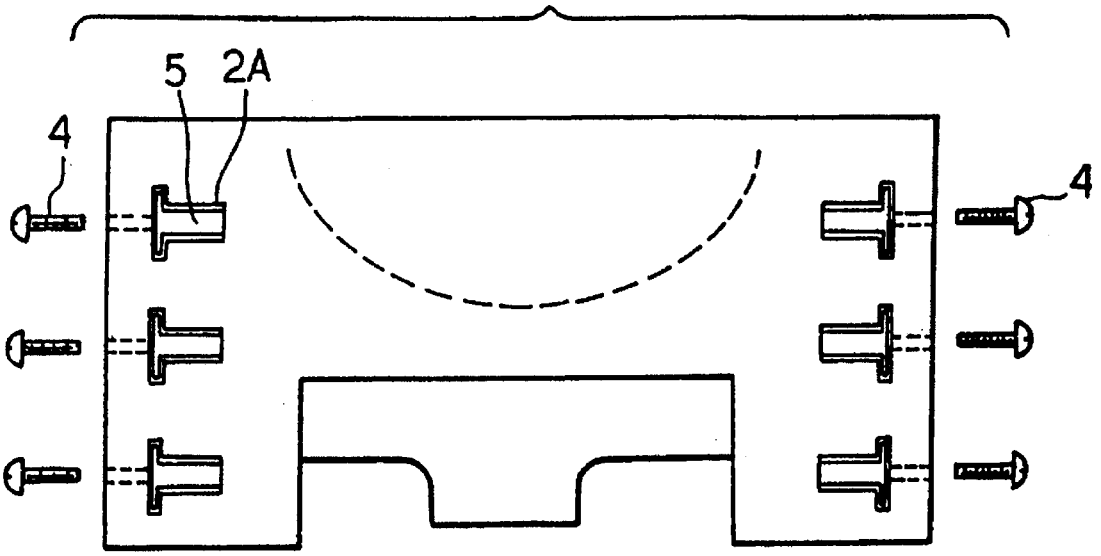
FIG. 14 is a rear elevation of the sink holder in FIGS. 13(A) and (B).

FIGS. 13(A) and (B) are exploded views of a sink holder installed on a wall with several fixing parts (3). FIG. 14 is a rear elevation of the sink holder shown in FIGS. 13(A) and (B). In FIG. 13(A) the sink holder (63), having strengthen holders (5), is inserted onto the fixing parts (3) attached on the wall with screws (4') and fastened to the fixing parts (3) by the bolts (4) through the holes on the side of the sink holder (63), corresponding to the inside of the bent portions of the fixing parts (3). The fixing parts (3) are arranged vertically in two rows on the wall, and the corresponding inserting places of the sink (63) are opened like the openings (2A) of the installing parts (2) which are to be combined. The strengthen holders (5) are inserted into the openings (2A) and the bolts are screwed into the inside of the fixing parts (3) with adjusting the proper assembling of fixing parts (3) and bolts (4). The fixing parts (3) are fastened more strongly on the wall with the fittings (65) as shown in FIG. 13(B), as opposed to fastening the fixing parts (3) without the fittings (65).

As described above, the rack structure has many advantages, including installation without any other assemblies and easy installation without any complicated procedures.

Figure 15:
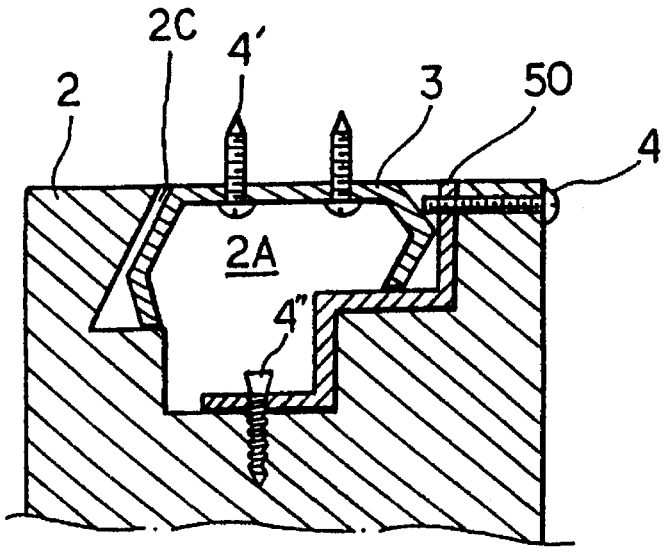
FIG. 15 is another embodiment of the holder according to this invention.

FIG. 15 is another embodiment of the holder structure according to this invention. In this embodiment the strengthen holder (50) is folded twice and the opening (2A) of the installing part (2) also has steps to fit the strengthen holder (50) and a bolt (4") is used to fix the strengthen holder (50) in the opening (2A).

The steps in the opening (2A) effectively increase the combination strength of the strengthen holder to accommodate bigger and heavier objects. The bolt (4) securely attaches the strengthen holder (50) onto the installing part (2) and reinforces the ability of the rack to support heavy ornaments (62) with assembling the bolt (4) pressed onto the fixing parts (3). The rack structure can be made of porcelain, ceramic, jade or marble, whichever is best for manufacturing convenience. In this embodiment for a convenient and strong assembly, a hole in the middle of the opening (2A) for screw (4') and a hole at one side of the installing part (2) for bolt (4) are formed by molding. FIG. 1 to FIG. 14 display various embodiments which use a strengthen holder (5) folded once to be applied for the rack structure or holder structure. The embodiment in FIG. 15 corresponds to the strengthen holder needed to sustain heavy ornaments.

Figure 16:
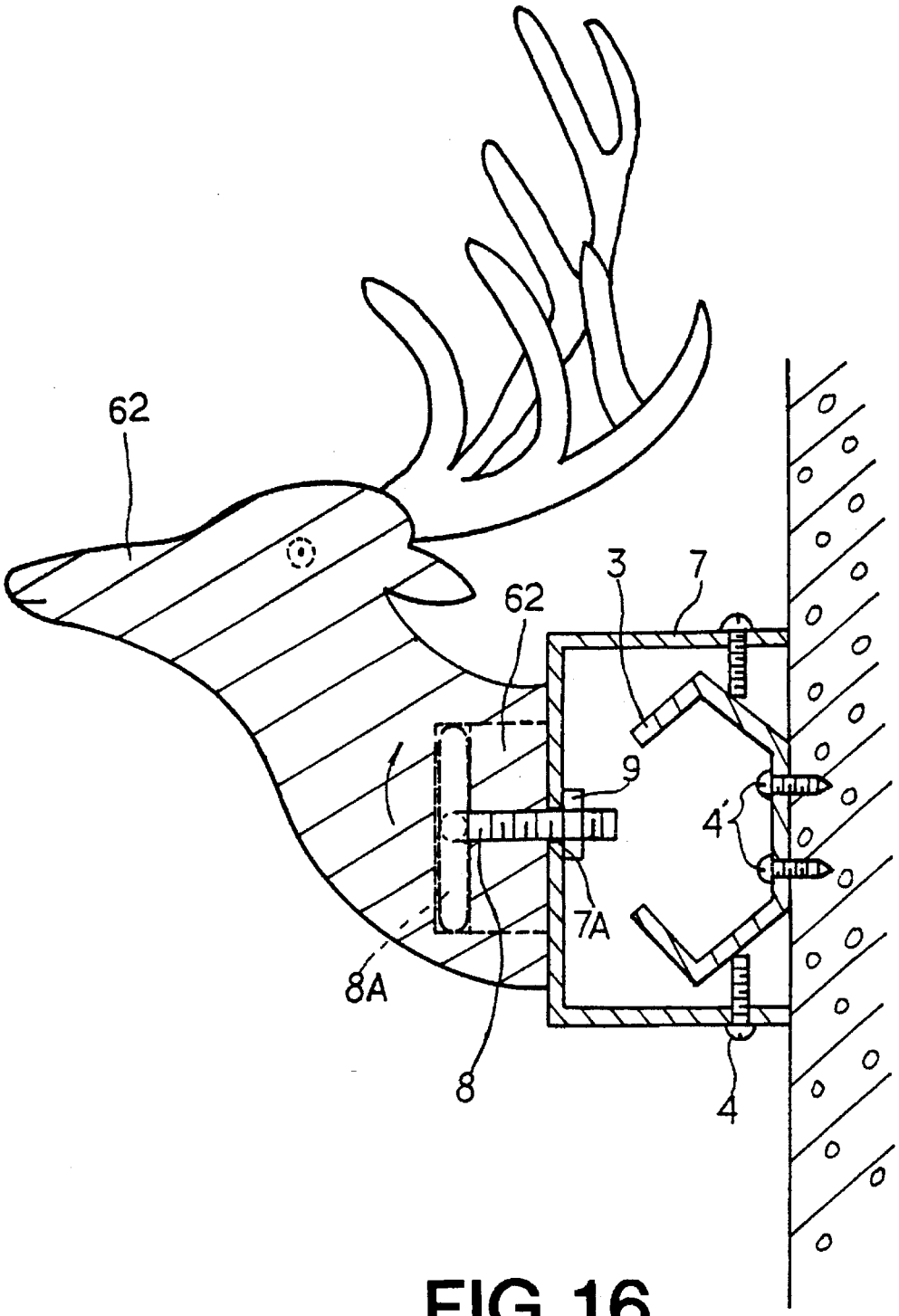
FIG. 16 is a sectional view of another embodiment of a holder installed on a wall according to this invention.

FIG. 16 shows another embodiment of the holder structure. The fixing part (3) is attached to the wall with screws (4') and the upholder (7) formed with the assembling member (8) is fastened to the fixing part (3) by the bolts (4). The upholder (7) has a hole (7A) for supporting the stuffing (62) by means of an assembling member (8) and nut (9). The other end of the assembling member (8) forms a hook (8A) installed in the stuffing (62) to sustain its heavy weight. The assembling member (8) has a "T" configuration. The hook (8A) of the assembling part (8) is inserted into the opening (62A) formed on the ornamental stuffing (62) and the opening (62A) of ornamental stuffing (62) is open and deep enough to receive the hook (8A) of the assembling part (8). The bottom of the opening (62A) has a semicircle space to catch the rotated hook (8A). When the hook (8A) is inserted into the opening (62A), it is turned 90° along the direction shown until it reaches the bottom. Once at the bottom of the opening (62A), the assembling part (8) is assembled with the upholder (7) by screwing nut (9). With such a holder structure, various ornaments can be fixed on the wall simply and conveniently by assembling the upholder (7) to the fixing part (3) with bolts (4).

Figure 17A:
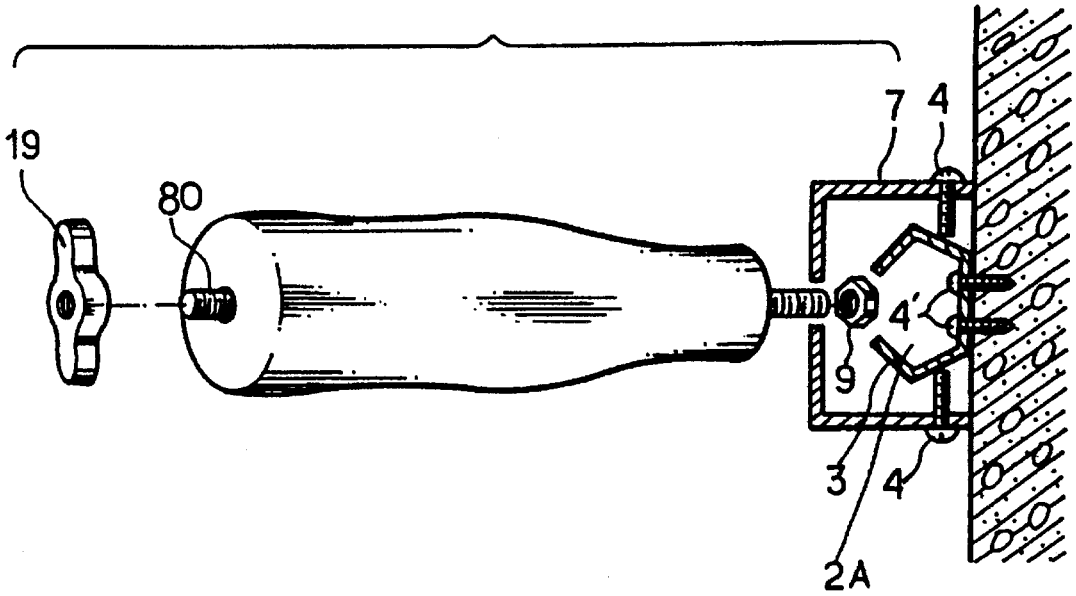
FIG. 17(A) is an exploded view of another embodiment of a holder installed on the wall according to this invention.
Figure 17B:
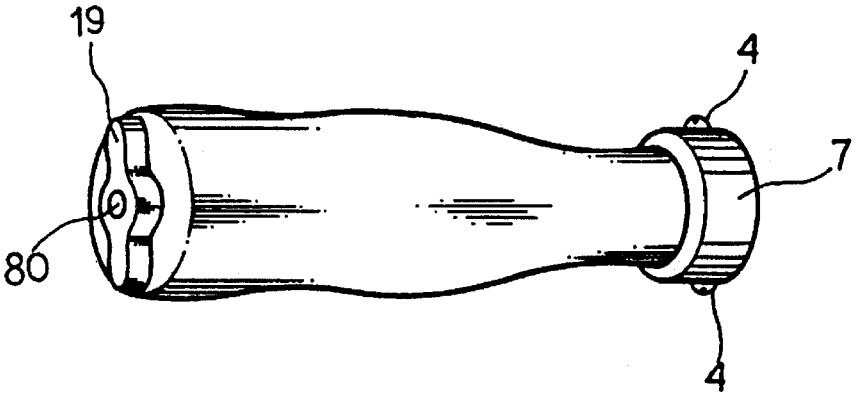
FIG. 17(B) is a perspective view of the installed holder in FIG. 17(A).

FIG. 17(A) shows an exploded view of another embodiment of the holder structure in FIG. 16. FIG. 17(B) shows a perspective view of the installed holder structure found in FIG. 17(A). In this embodiment, the towel rack forms a long bar protruding from the wall, which is made of porcelain, ceramic or jade, and the assembling part (80) is combined with the upholder (7) by two nuts (9), (19) at both ends of the assembling part (80).

Figure 18:
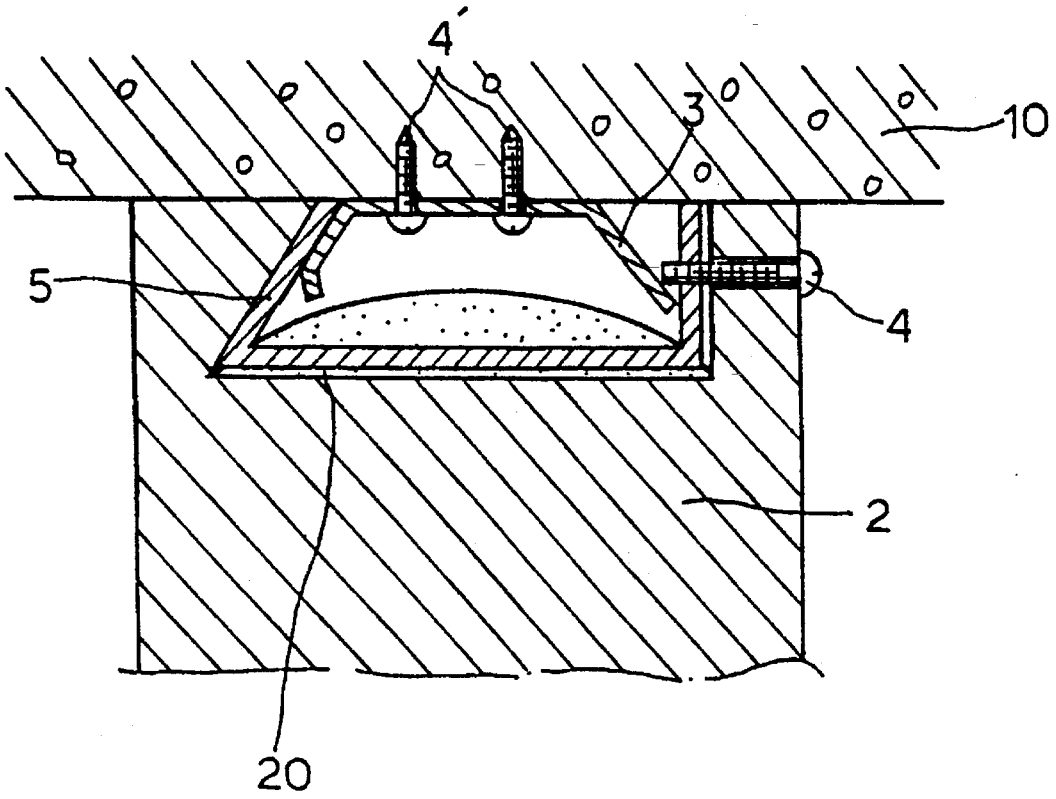
FIG. 18 is another embodiment of a holder or rack fixed by adhesive agent.

FIG. 18 shows another embodiment of the holder or rack being affixed by an adhesive agent. As shown in FIG. 15, a screw (4') can be inserted into the center of the installing part (2) and the strengthen holder (50) is arranged to reinforce the installing part (2) by bolt (4). However the strengthen holder (50) can be attached on the installing part (2) with applying adhesive (20) (a mixture of epoxy and hardener) at the bottom of the opening (2A). The bolt (4) is needed only for attaching the installing part (2) on the wall (10) with fixing part (3). This protects an installing part made of porcelain, ceramic, jade or other such material which can be easily fractured.

Therefore the formation of the ornaments attached to the rack can be changed according to the manufacturer.

This invention has many advantages, especially in attaching or affixing the holder of ornaments of different materials and weight.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A rack structure for hanging an object on a wall, said rack structure comprising:

an installing part having a flat mounting panel with opposed top and bottom ends, an outer surface for mounting the object to be hung on the wall and an opposed inner surface, top and bottom outer supports projecting from the respective top and bottom ends of the mounting panel and having wall mounting edges for engagement on the wall, said outer top support including a threaded bolt hole passing therethrough;

a fixing part disposed between the top and bottom supports of the installing part, said fixing part including a planar base for engaging the wall, said base having opposed top and bottom ends and top and bottom holes formed through said base, a top inner support projecting unitarily from said top end of said base and having a portion projecting angularly toward said top outer support, a bottom inner support extending from said bottom end of said base and into contact with portions of the inner surface of the mounting panel of the installing part in proximity to the bottom outer support;

a bolt threadedly engaged in the bolt hole of the top outer support and having an end engaging the angularly projecting portion of the top inner support; and top and bottom screws passing through the holes of the base of the fixing part and into the wall, for securing the fixing part to the wall;

whereby moments generated by gravitational forces on the object are resisted by the bolt to hold the top outer support adjacent the wall; and whereby the bottom inner support and the bottom outer support resist inward movement of the bottom end of the mounting panel toward the wall in response to moments generated by gravitational forces acting on the object.

2. The rack structure as claimed in claim 1, wherein said installing part is formed and made of a non-metallic material.

* * * * *